US010364694B2

(12) United States Patent
Ribarov et al.

(10) Patent No.: US 10,364,694 B2
(45) Date of Patent: Jul. 30, 2019

(54) TURBOMACHINE BLADE CLEARANCE CONTROL SYSTEM

(71) Applicant: United Technologies Corporation, Farmington, CT (US)

(72) Inventors: Lubomir A. Ribarov, West Hartford, CT (US); Leo J. Veilleux, Jr., Wethersfield, CT (US); James S. Elder, South Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 385 days.

(21) Appl. No.: 15/105,358

(22) PCT Filed: Dec. 1, 2014

(86) PCT No.: PCT/US2014/067882

§ 371 (c)(1),
(2) Date: Jun. 16, 2016

(87) PCT Pub. No.: WO2015/094622

PCT Pub. Date: Jun. 25, 2015

(65) Prior Publication Data

US 2016/0312645 A1 Oct. 27, 2016

Related U.S. Application Data

(60) Provisional application No. 61/916,920, filed on Dec. 17, 2013.

(51) Int. Cl.
*F01D 11/20* (2006.01)
*F01D 11/22* (2006.01)
(Continued)

(52) U.S. Cl.
CPC ..... *F01D 11/20* (2013.01); *F01D 5/12* (2013.01); *F01D 11/22* (2013.01); *F01D 25/24* (2013.01);
(Continued)

(58) Field of Classification Search
CPC . F01D 11/20; F01D 5/12; F01D 11/22; F01D 25/24; F05D 2240/307; F05D 2220/30; F05D 2260/57
(Continued)

(56) References Cited

U.S. PATENT DOCUMENTS 3,227,418 A * 1/1966 West ..... F01D 11/22 415/127
4,247,247 A * 1/1981 Thebert ..... F01D 11/22 415/113
(Continued)

FOREIGN PATENT DOCUMENTS

EP 0113952 A1 * 7/1984 ..... F15B 15/10
EP 1741880 A2 1/2007
EP 1775424 A2 4/2007

OTHER PUBLICATIONS

Wickramasinghe, et al., "A Novel Adaptive Structural Impedance Control Approach to Suppress Aircraft Vibration and Noise," NATO R&T Organization Report RTO-MP-AVT-110, pp. 16-1-16-14. (Paper presented at the RTO AVT Symposium on Habitability of Combat.
(Continued)

*Primary Examiner* — Carlos A Rivera
*Assistant Examiner* — Eric J Zamora Alvarez
(74) *Attorney, Agent, or Firm* — Cantor Colburn LLP

(57) ABSTRACT

A turbomachine blade clearance system can include an actuator having an anchor portion for fixation to an interior surface of a turbomachine housing and an actuating portion for actuating movement relative to the anchor portion. A
(Continued)

turbomachine blade seal can be operatively connected to the actuating portion of the actuator and configured to move relative to the turbomachine housing to adjust a distance from a turbomachine blade of a turbomachine to maintain a predetermined gap clearance between the blade seal and the blade.

17 Claims, 3 Drawing Sheets

(51) Int. Cl.
*F01D 5/12* (2006.01)
*F01D 25/24* (2006.01)

(52) U.S. Cl.
CPC .... *F05D 2220/30* (2013.01); *F05D 2240/307* (2013.01); *F05D 2260/57* (2013.01)

(58) Field of Classification Search
USPC ..... 415/127
See application file for complete search history.

(56) References Cited

U.S. PATENT DOCUMENTS 4,683,716 A 8/1987 Wright et al.
4,714,404 A * 12/1987 Lardellier ..... F01D 11/22 15/171
4,844,688 A 7/1989 Clough et al.
5,049,033 A * 9/1991 Corsmeier ..... F01D 11/22 415/127
5,211,534 A 5/1993 Catlow
5,263,816 A 11/1993 Weimer et al.
5,456,576 A 10/1995 Lyon
5,791,872 A 8/1998 Owen
5,871,333 A 2/1999 Halsey
6,116,852 A 9/2000 Pierre et al.
6,672,831 B2 * 1/2004 Brandl ..... F01D 11/22 415/173.2
7,125,223 B2 * 10/2006 Turnquist ..... F01D 11/20 415/173.2
7,165,937 B2 1/2007 Dong et al.
7,625,169 B2 * 12/2009 Manzoori ..... F01D 11/22 415/14
7,654,791 B2 2/2010 Werner
8,011,883 B2 * 9/2011 Schwarz ..... F01D 11/20 415/127
8,186,945 B2 * 5/2012 Bhatnagar ..... F01D 11/22 415/173.1
8,240,986 B1 * 8/2012 Ebert ..... F01D 11/001 415/173.2
8,534,996 B1 * 9/2013 Pankey ..... F01D 11/22 415/127
2002/0071763 A1 6/2002 Brandl et al.
2004/0120809 A1 6/2004 Loftus
2009/0302516 A1 * 12/2009 Steele ..... B64C 13/46 267/140.15
2010/0209231 A1 * 8/2010 Lewis ..... F01D 11/22 415/127
2013/0209240 A1 * 8/2013 McCaffrey ..... F01D 11/22 415/173.2

OTHER PUBLICATIONS

Jolly, et al., "Properties and Applications of Commercial Magnetorheological Fluids," Thomas Lord Research Center, Lord Corporation, Cary, NC 27511.
Notification of Transmittal of the International Search Report of the International Searching Authority, or the Declaration; PCT/US2014067882; dated Mar. 31, 2015. 3 pages.
Notification of Transmittal of the Written Opinion of the International Searching Authority, or the Declaration; PCT/US2014067882; dated Mar. 31, 2015. 7 pages.

* cited by examiner

Fig. 1
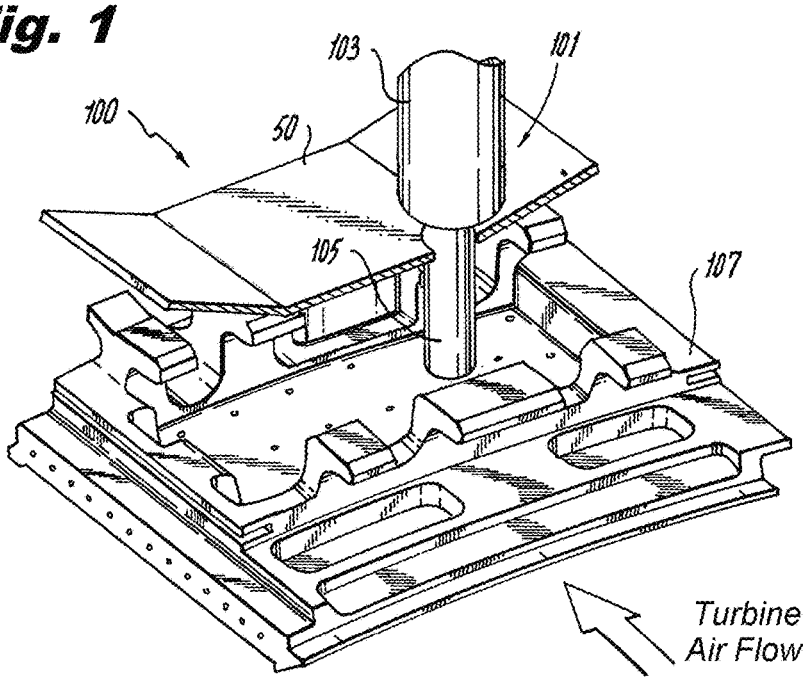
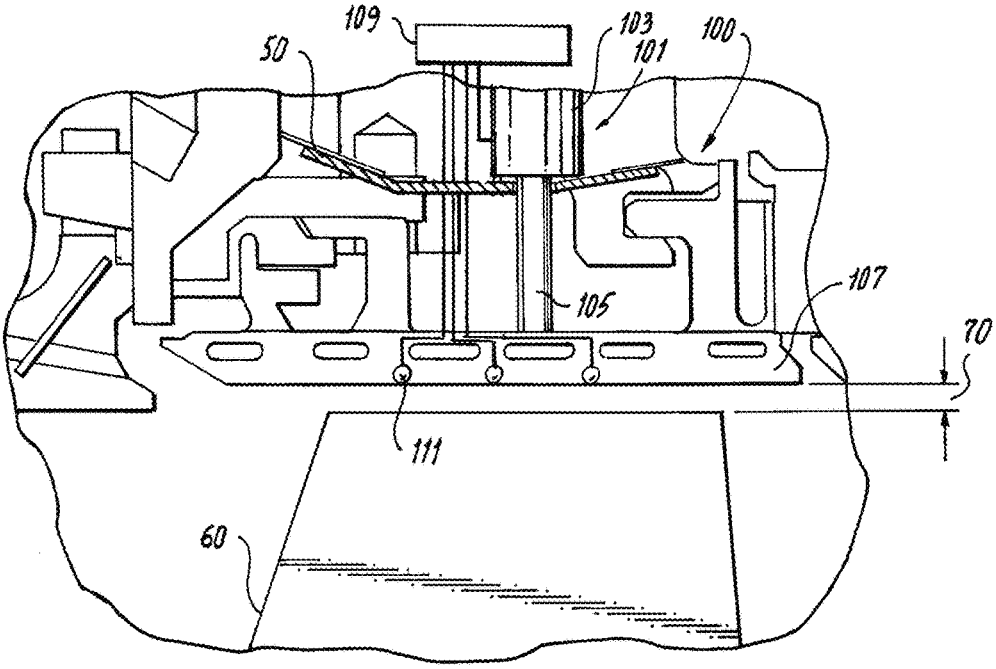
Fig. 2

Fig. 3
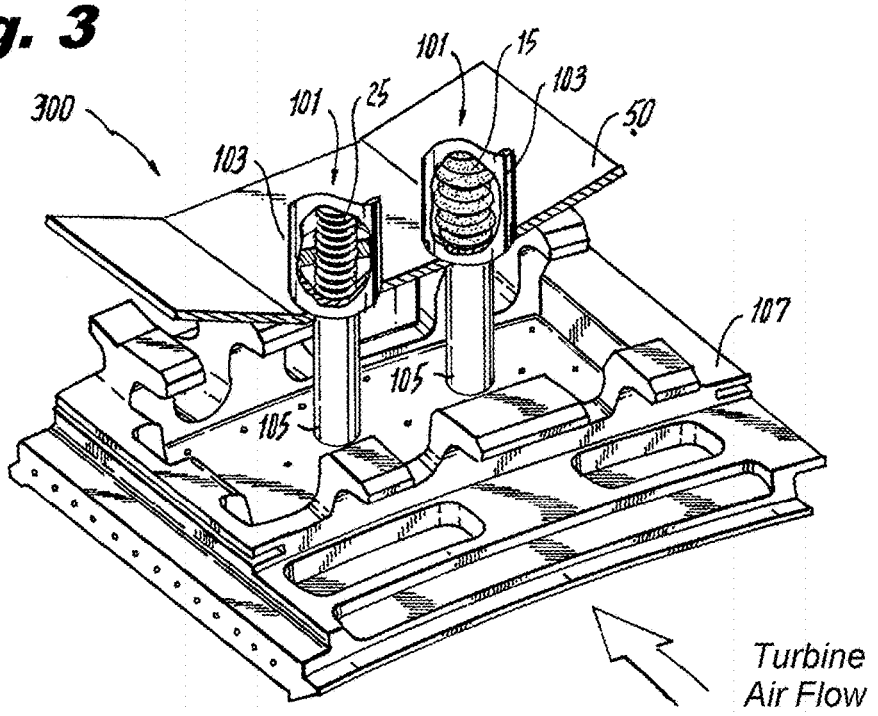
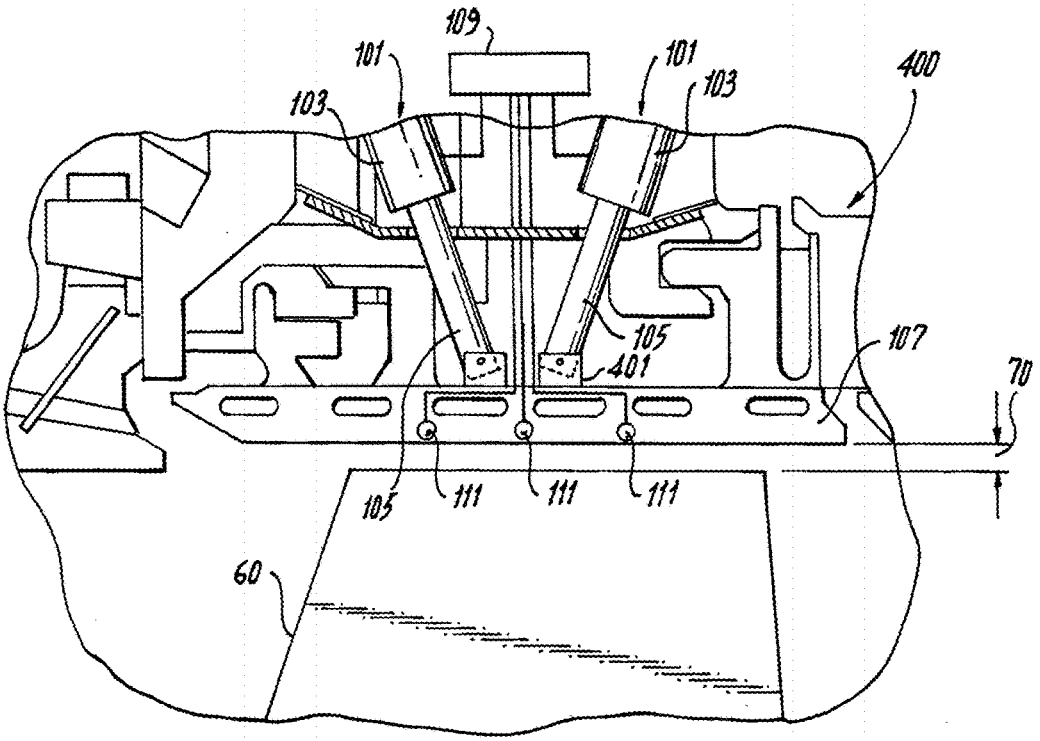
Fig. 4

TURBOMACHINE BLADE CLEARANCE CONTROL SYSTEM

RELATED APPLICATIONS

This application is a National Phase Application of Patent Application PCT/US2014/067882 filed on Dec. 1, 2014, which claims the benefit of and priority to U.S. Provisional Patent Application No. 61/916,920 filed Dec. 17, 2013, the contents of which are incorporated herein by reference in their entirety.

BACKGROUND

1. Field

The present disclosure relates to turbomachines, and more particularly to turbomachine blade clearance.

2. Description of Related Art

Turbomachines are meticulously designed to have minimal clearance between the outer edges of the blades and the inner surfaces of the turbomachine casing. With more clearance comes more aerodynamic inefficiency in the blades. Turbine blades, for example, have a series of TBC (Thermal Barrier Coatings) coated plates surrounding each rotor stage. Initially, the ceramic contacts the outer edge of the plate and is abraded to form fit the turbine blade. However, even such tightly engineered technology cannot prevent the relative differential thermal expansion of the turbomachine blades and surrounding components, leading to a gap or excessive contact under certain operability conditions. The clearances between the blades and seals are typically oversized for normal operation to prevent rubbing in more extreme conditions. The oversizing of these gaps represents a loss in the overall engine cycle efficiency.

Such conventional methods and systems have generally been considered satisfactory for their intended purpose. However, there is still a need in the art for a system to improve sealing of turbine blades, for example. The present disclosure provides a solution for this problem.

SUMMARY

In at least one aspect of this disclosure, a turbomachine blade clearance system includes an actuator having an anchor portion for fixation to an interior surface of a turbomachine housing and an actuating portion for actuating movement relative to the anchor portion. The system further includes a turbomachine blade seal operatively connected to the actuating portion of the actuator and configured to move relative to the turbomachine housing to adjust a distance from a turbomachine blade of a turbomachine to maintain a predetermined gap clearance between the blade seal and the blade.

In at least some embodiments, the actuating portion of the actuator can include bellows having a magneto-rheological fluid (MRF) disposed therein configured to modulate the length of the bellows under the influence of an applied magnetic field. The actuating portion of the actuator can include a linear mechanical actuator.

In some embodiments, the turbomachine blade clearance system can further include a controller configured to control actuation of the actuating portion. It is also envisioned that the turbomachine blade clearance system can have memory operatively connected to cause execution of a prediction algorithm by the controller to cause actuation of the actuating portion to move the turbomachine blade seal to a predicted position for a desired blade clearance based on at least one input. The at least one input can be one or more of blade rotational speed, temperature, pressure, blade acceleration, and/or thrust input.

In some embodiments, the turbomachine blade clearance system further includes a sensor configured to sense a blade clearance, the sensor operatively connected to the controller for actuation of the actuating portion to move the turbomachine blade seal to a desired position for a desired blade clearance based on sensed blade clearance.

In at least one aspect of this disclosure, a turbine blade clearance system includes a plurality of actuators, each including an anchor portion for fixation to an interior surface of a turbomachine housing, an actuating portion for actuating movement relative to the anchor portion and a plurality of turbine blade seals operatively connected to the actuating portions of the actuators and configured to move relative to the turbomachine housing to adjust a distance from a turbine blade of a turbomachine.

In at least some embodiments, the plurality of actuators can include a suitable number of actuators for a specific engine size disposed circumferentially around the interior surface of the turbomachine.

The actuators can be radially oriented such that actuation of the actuating portion of each actuator causes radial movement of the turbine blade seal attached thereto. It is also envisioned that the actuators can be oriented at an angle oblique to the radial axis such that actuation of the actuating portion of each actuator causes radial and axial movement of the turbine blade seal attached thereto.

In some embodiments, the actuators can be axially oriented such that actuation of the actuating portion of each actuator causes axial movement of the turbine blade seal attached thereto. Further, the turbine blade seals can be disposed in a conical section of a turbomachine such that each blade seal is at an angle to a longitudinal axis of the turbomachine such that axial actuation of the actuating portion of each actuator causes axial movement of the angled turbine blade seal attached thereto. It is envisioned that multiple actuators can be connected to each turbine blade seal for orientation control.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1 is a perspective view of an embodiment of a turbomachine blade clearance system constructed in accordance with the present disclosure, showing an actuator connected to a turbomachine blade seal;

FIG. 2 is a partial, cross-sectional view of the system of FIG. 1, shown disposed in a turbomachine relative to a turbomachine blade;

FIG. 3 is a perspective view of an embodiment of a turbomachine blade clearance system constructed in accordance with the present disclosure, showing dual actuators connected to a turbomachine blade seal;

FIG. 4 is a partial, cross-sectional view of an embodiment of a turbomachine blade clearance system constructed in accordance with the present disclosure, showing angled actuators connected to a turbomachine blade seal and disposed in a turbomachine relative to a turbomachine blade;

DETAILED DESCRIPTION

Figure 5:
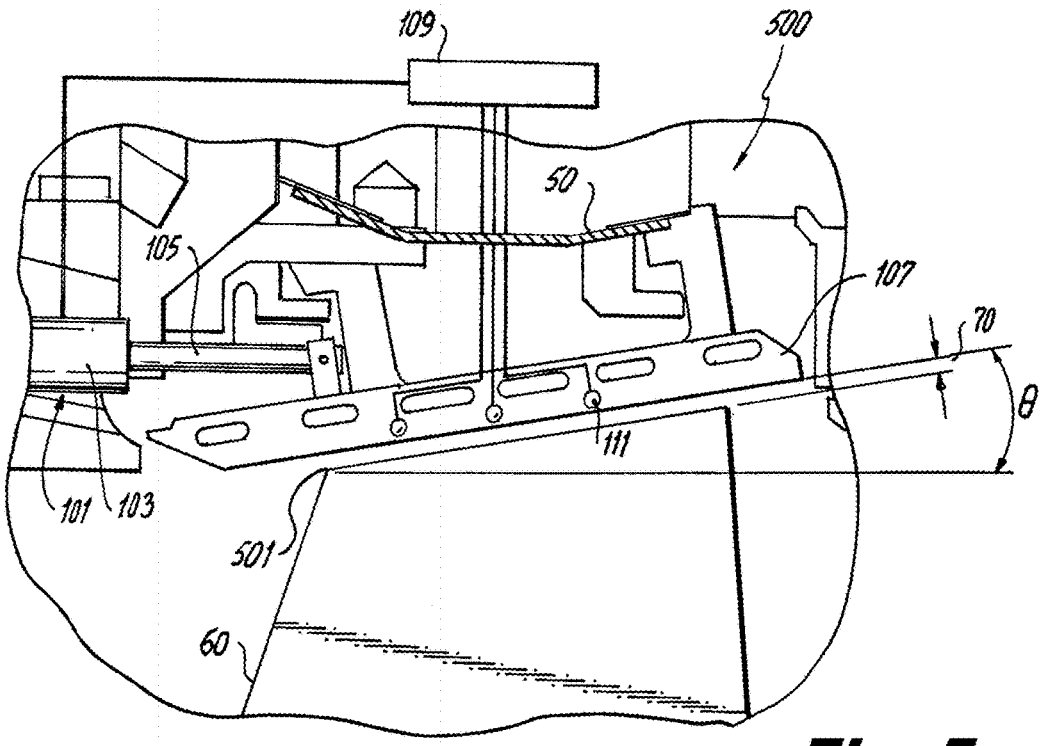
FIG. 5 partial, cross-sectional view of an embodiment of a turbomachine blade clearance system constructed in accordance with the present disclosure, showing a horizontal actuator connected to a turbomachine blade seal and disposed in a turbomachine relative to a turbomachine blade.

Reference will now be made to the drawings wherein like reference numerals identify similar structural features or aspects of the subject disclosure. For purposes of explanation and illustration, and not limitation, a perspective view of an embodiment of a turbomachine blade clearance system in accordance with the disclosure is shown in FIGS. 1 and 2, and is designated generally by reference character 100. Other example embodiments of the turbomachine blade clearance system in accordance with the disclosure, or aspects thereof, are provided in FIGS. 3-5, as will be described. The systems and methods described herein can be used to control a gap size between a turbomachine blade and a turbomachine blade seal to control the amount of leakage therebetween.

In at least one aspect of this disclosure, the turbomachine blade clearance system 100 includes an actuator 101 having an anchor portion 103 for fixation to an interior surface of a turbomachine housing 50 and an actuating portion 105 for actuating movement relative to the anchor portion 103. The system 100 further includes a turbomachine blade seal 107 operatively connected to the actuating portion 105 of the actuator 101 and configured to move relative to the turbomachine housing 50 to adjust a distance from a turbomachine blade 60 (shown in FIG. 2) of a turbomachine to maintain a predetermined blade clearance 70 (shown in FIG. 2) between the blade seal 107 and the blade 60.

The turbomachine blade seal 107 can be any suitable turbomachine blade outer air seal such as, but not limited to, a ceramic coated (e.g. TBC) turbine outer air blade seal, and can be attached to the actuating portion 105 in any suitable manner, including, but not limited to, adhesion, welding, bolting, the like, and/or any combination thereof.

In at least some embodiments, the actuating portion 105 of the actuator 101 can include bellows 15 (shown in FIG. 3) having a magneto-rheological fluid disposed therein configured to elongate the bellows 15 under the influence of a magnetic field. Alternatively or conjunctively, the actuating portion 105 of the actuator 101 can include a linear and/or rotational mechanical actuator 25 (shown in FIG. 3) or any other suitable actuator for moving the turbomachine blade seal 107.

The actuator 101 can be configured to move the turbomachine blade seal 107 in any suitable increment or distance at any suitable speed. In some embodiments, the actuator 101 is configured to move the turbomachine blade seal 107 within a total range of about 0.0254 mm (about 0.001 in) to about 2.54 mm (about 0.100 in) radially, more specifically about 1.27 mm (about 0.050 in) radially, between a fully retracted position and a fully extended position. While specific ranges are disclosed, it is contemplated that, the movable range is dependent upon the size and type of the engine and can be selected to account for maximum expansion and contraction of certain engine components, e.g., a turbomachine blade 60.

In some embodiments, the actuator 101 can move the turbomachine blade seal 107 between a fully retracted position and a fully extended position within about 5 seconds. For example, in the case where the fully extended position is about 1.27 mm (about 0.050 in) from the fully retracted position, the actuator 101 can be configured to move at a rate of about 0.254 mm/s (about 0.01 in/s) in a steady state acceleration or deceleration. In some operations, during a slam acceleration and/or deceleration state, the actuator can be configured to move the turbomachine blade seal 107 between a fully retracted position and a fully extended position within about 2.5 seconds (or about twice as fast).

The actuator 101 can provide any suitable force to overcome any inertial considerations of the system 100 and any internal forces associated with a turbomachine. In some embodiments, the force provided by the actuators 101 can be about 444.82 N (about 100 lbf) to about 1334.47 N (about 300 lbf), more specifically about 1067.57 N (about 240 lbf).

The actuator 101 can be configured to operate in high temperature conditions associated with a turbomachine, such as, but not limited to, between about 93.33 degrees C. (about 200 degrees F.) to about 815.56 degrees C. (about 1500 degrees F.). In other embodiments, the actuator 101 can be configured to operate in any suitable temperature.

Actuator 101 can be controlled via a mechanical system, electromechanical system, or electrical circuit attached thereto. The actuator 101 can be hard wired or controlled wirelessly via any suitable control mechanism.

In some embodiments, the turbomachine blade clearance system 100 can further include a controller 109 configured to control actuation of the actuating portion 105. It is also envisioned that the turbomachine blade clearance system 100 can have memory operatively connected to cause execution of a prediction algorithm by the controller to cause actuation of the actuating portion 105 to move the turbomachine blade seal 107 to a predicted position for a desired blade clearance 70 based on at least one input. The at least one input can be one or more of blade rotational speed, temperature, pressure, blade acceleration, and/or thrust input.

In some embodiments, the turbomachine blade clearance system 100 further includes at least one sensor 111 configured to sense a blade clearance 70 (see FIGS. 2, 4, 5, and 6). The sensor 111 can be operatively connected to the controller 109 for actuation of the actuating portion 105 to move the turbomachine blade seal 107 to a desired position for a desired blade clearance based on a sensed blade clearance 70.

Referring now to FIGS. 3 and 4, the turbomachine blade clearance system 300, 400 can further include a plurality of actuators 101 as described above connected to the turbomachine blade seal 107 as describe above. As shown in FIG. 3, the actuators 101 can be radially oriented such that actuation of the actuating portion 105 of each actuator 101 causes radial movement of the turbomachine blade seal 107 attached thereto, similar to the embodiment shown in FIGS. 1 and 2.

Referring specifically to FIG. 4, it is also envisioned that the actuators 101 can be oriented at an angle oblique to the radial axis such that actuation of the actuating portion 105 of each actuator 101 causes radial and axial movement of the turbomachine blade seal 107 attached thereto in order to control a tilt angle or other orientation of the turbomachine blade seal 107 to more precisely control blade clearance 70. In such embodiments, actuating portions 105 can be operatively connected to the blade seal 107 via any suitable moving connection, e.g., pin connection 401 or the like, allowing movement of the blade seal 107 relative to the actuating portions 105.

Figure 6:
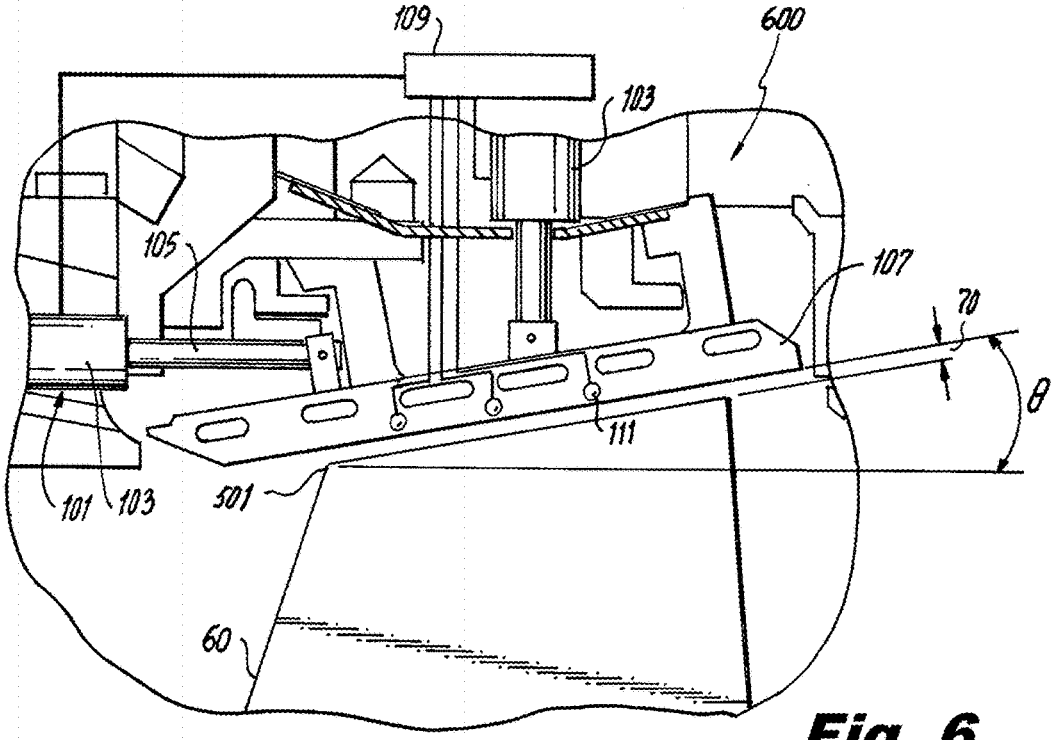
FIG. 6 partial, cross-sectional view of an embodiment of a turbomachine blade clearance system constructed in accordance with the present disclosure, showing a horizontal actuator and a vertical actuator connected to a turbomachine blade seal and disposed in a turbomachine relative to a turbomachine blade.

Referring specifically to the turbomachine blade clearance system 500 of FIG. 5, in some embodiments, the actuator 101 can be axially oriented such that actuation of the actuating portion 105 extending from the anchor portion 105 of each actuator 101 causes axial movement of the turbine blade seal 107 attached thereto. In such embodiments, the blade seal 107 and/or the turbomachine housing 50 can be shaped and/or positioned such that there is an angle "θ" between a surface of the blade seal 107 and a longitudinal axis of the turbomachine. For example, the turbine blade seal 107 can be disposed in a conical section of a turbomachine such that each blade seal 107 is at an angle to a longitudinal axis of the turbomachine. In such embodiments, when axial actuation of the actuating portion 105 of each actuator 101 causes axial movement of the angled turbomachine blade seal 107 attached thereto, the turbomachine blade seal 107 can be moved closer to or further from an edge 501 of blade 60 to control the seal therebetween. Controlling the blade seal 107 axially in this manner can allow for more precise clearance control beyond the precision limits of actuator 101 as a function of the angular component. The turbomachine blade clearance system 600 of FIG. 6 is similar to that shown in FIG. 5, except that there is an added radial actuator 101 for increased precision control.

In another aspect of this disclosure, a turbomachine can include a plurality of actuators 101 having blade seals 107 attachable thereto. In some embodiments, a turbomachine can include at least 21 actuators 101 disposed circumferentially around the interior surface of the turbomachine. Each actuator 101 can be controlled independently or in any suitable combination via a controller 109 of the above described control systems. The number of actuators 101 disposed in a turbomachine can vary depending on the size of the turbomachine and the amount of actuators 101 connected to each blade seal 107. For example, the above 21 actuator embodiment can include 42 actuators where there are two actuators 101 per blade seal 107. In other embodiments, smaller engines may have less actuators 101 and larger engines may have more.

Further disclosed herein is a method for controlling blade clearance 70 including actuating an actuator 101 attached to a blade seal 107 to move the blade seal 107 to a predetermined and/or desired distance from blade 60.

The methods and systems of the present disclosure, as described above and shown in the drawings, provide for a turbomachine with superior properties including enhanced blade clearance control. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A turbomachine blade clearance system, comprising:

an actuator including an anchor portion for fixation to an interior surface of a turbomachine housing and an actuating portion for actuating movement relative to the anchor portion, wherein the actuating portion of the actuator includes bellows having a magneto-rheological fluid disposed therein and the bellows is configured to elongate under influence of a magnetic field to the magneto-rheological fluid; and a turbomachine blade seal operatively connected to the actuating portion of the actuator and configured to move relative to the turbomachine housing to adjust a distance from a turbomachine blade of a turbomachine to maintain a predetermined gap clearance between the blade seal and the blade.

2. The turbomachine blade clearance system of claim 1, further comprising a plurality of actuators connected to the turbomachine blade seal.

3. The turbomachine blade clearance system of claim 1, further comprising a controller configured to control actuation of the actuating portion.

4. The turbomachine blade clearance system of claim 3, wherein the controller is configured to cause actuation of the actuating portion to move the turbomachine blade seal to a predicted position for a desired blade clearance based on at least one input.

5. The turbomachine blade clearance system of claim 4, wherein the at least one input is blade rotational speed, temperature, pressure, blade acceleration, or thrust input.

6. The turbomachine blade clearance system of claim 3, further comprising a sensor configured to sense a blade clearance, the sensor operatively connected to the controller for actuation of the actuating portion to move the turbomachine blade seal to a desired position for a desired blade clearance based on sensed blade clearance.

7. A turbine blade clearance system, comprising:

a plurality of actuators, each including an anchor portion for fixation to an interior surface of a turbomachine housing and an actuating portion for actuating movement relative to the anchor portion, wherein the actuating portion of at least one of the plurality of actuators includes bellows having a magneto-rheological fluid disposed therein and the bellows is configured to elongate under influence of a magnetic field to the magneto-rheological fluid; and a plurality of turbine blade seals operatively connected to the actuating portions of the actuators and configured to move relative to the turbomachine housing to adjust a distance from a turbine blade seal to a turbine blade of a turbomachine.

8. The turbine blade clearance system of claim 7, wherein the actuating portion of at least one of the actuators includes a linear mechanical actuator.

9. The turbine blade clearance system of claim 7, wherein the plurality of actuators are disposed circumferentially around the interior surface of the turbomachine.

10. The turbine blade clearance system of claim 7, further comprising a controller configured for actuation of the actuating portion of each actuator either independently or together.

11. The turbine blade clearance system of claim 10, wherein the controller is configured to cause actuation of the actuating portion of each actuator to move the turbine blade seal to a predicted position for a desired blade clearance based on at least one input.

12. The turbine blade clearance system of claim 10, further comprising a sensor configured to sense a blade clearance, the sensor operatively connected to the controller for actuation of the actuating portion of each actuator to move the turbine blade seal to a desired position for a desired blade clearance based on sensed blade clearance.

13. The turbine blade clearance system of claim 7, wherein the actuators are radially oriented such that actuation of the actuating portion of each actuator causes radial movement of the turbine blade seal attached thereto.

14. The turbine blade clearance system of claim 7, wherein the actuators are oriented at an angle oblique to a radial axis with respect to the turbine blade seal such that actuation of the actuating portion of each actuator causes radial and axial movement of the turbine blade seal attached thereto.

15. The turbine blade clearance system of claim 7, wherein the actuators are axially oriented such that actuation of the actuating portion of each actuator causes axial movement of the turbine blade seal attached thereto.

16. The turbine blade clearance system of claim 7, wherein the turbine blade seals are disposed in a conical section of a turbomachine such that each blade seal is at an angle to a longitudinal axis of the turbomachine and wherein the actuators are axially arranged such that actuation of the actuating portion of each actuator causes axial movement of the turbine blade seal attached thereto.

17. The turbine blade clearance system of claim 7, wherein multiple actuators are connected to each turbine blade seal for orientation control.

* * * * *